US006254501B1

(12) United States Patent
Chang

(10) Patent No.: US 6,254,501 B1
(45) Date of Patent: Jul. 3, 2001

(54) METAL RACKET

(76) Inventor: Kuo-Yi Chang, No. 6, Lane 305 Chung Shan Road Sec. 3 Tan Tzu, Taichung (TW)

( * ) Notice: Subject to any disclaimer, the term of this patent is extended or adjusted under 35 U.S.C. 154(b) by 0 days.

(21) Appl. No.: 09/499,697

(22) Filed: Feb. 8, 2000

(51) Int. Cl.[7] ..... A63B 49/12; A63B 49/08
(52) U.S. Cl. ..... 473/545; 473/549; 473/523
(58) Field of Search ..... 473/520, 521, 473/523, 524, 545, 549

(56) References Cited

U.S. PATENT DOCUMENTS

| | | | | |
|---|---|---|---|---|
| 5,092,594 | * | 3/1992 | Jang | 473/523 |
| 5,516,101 | * | 5/1996 | Peng | 473/523 |
| 5,865,694 | * | 2/1999 | Duong-Van | 473/520 |
| 6,017,283 | * | 1/2000 | Hagey | 473/551 |
| 6,050,908 | * | 4/2000 | Muhlhausen | 473/520 X |

FOREIGN PATENT DOCUMENTS

| | | | | |
|---|---|---|---|---|
| 4339133 | * | 7/1994 | (DE) | 473/FOR 183 |
| 2198649 | * | 6/1988 | (GB) | 473/FOR 183 |
| 2262045 | * | 6/1993 | (GB) | 473/FOR 183 |
| 2273245 | * | 6/1994 | (GB) | 473/FOR 183 |

* cited by examiner

*Primary Examiner*—Raleigh W. Chiu
(74) *Attorney, Agent, or Firm*—Dougherty & Troxell

(57) ABSTRACT

A metal racket includes a shock removing member, a frame and a handle. The shock removing member has a fitting hole for a lower end of the frame having two shaft rods to fit through and into a hollow interior of the handle and fixed therein by rivets passing through rivet holes of the handle, the shock removing member and the shaft rods. Thus a shock reducing hollow space is formed between the lower end of the shock removing member and the lower end of the handle, When the racket receives shock in hitting a ball, the shock is firstly buffered by the shock removing member and then reduced by the shock reducing hollow space again.

6 Claims, 5 Drawing Sheets

METAL RACKET

BACKGROUND OF THE INVENTION

This invention relates to a metal racket, particularly to one provided with shock-removing device.

Conventional metal rackets generally have a handle filled with foam material in its interior for reducing shock in hitting a ball, but foam material has limited effect in removing shock, and increases the weight of a handle, disadvantageous to lighten the handle.

SUMMARY OF THE INVENTION

This invention has been devised to offer a metal racket having a shock removing means instead of foam material to be filled in the handle so as to reduce shock and also lighten the weight of the handle of a racket.

The feature of the invention is a shock removing member and a shock reducing space for interrupting shock to be transmitted to the handle, and at the same time reducing the weight of the handle effectively for a user to acquire stronger attack.

BRIEF DESCRIPTION O DRAWINGS

This invention will be better understood by referring to the accompanying drawings, wherein.

DETAILED DESCRIPTION OF THE PREFERRED EMBODIMENT

Figure 1:
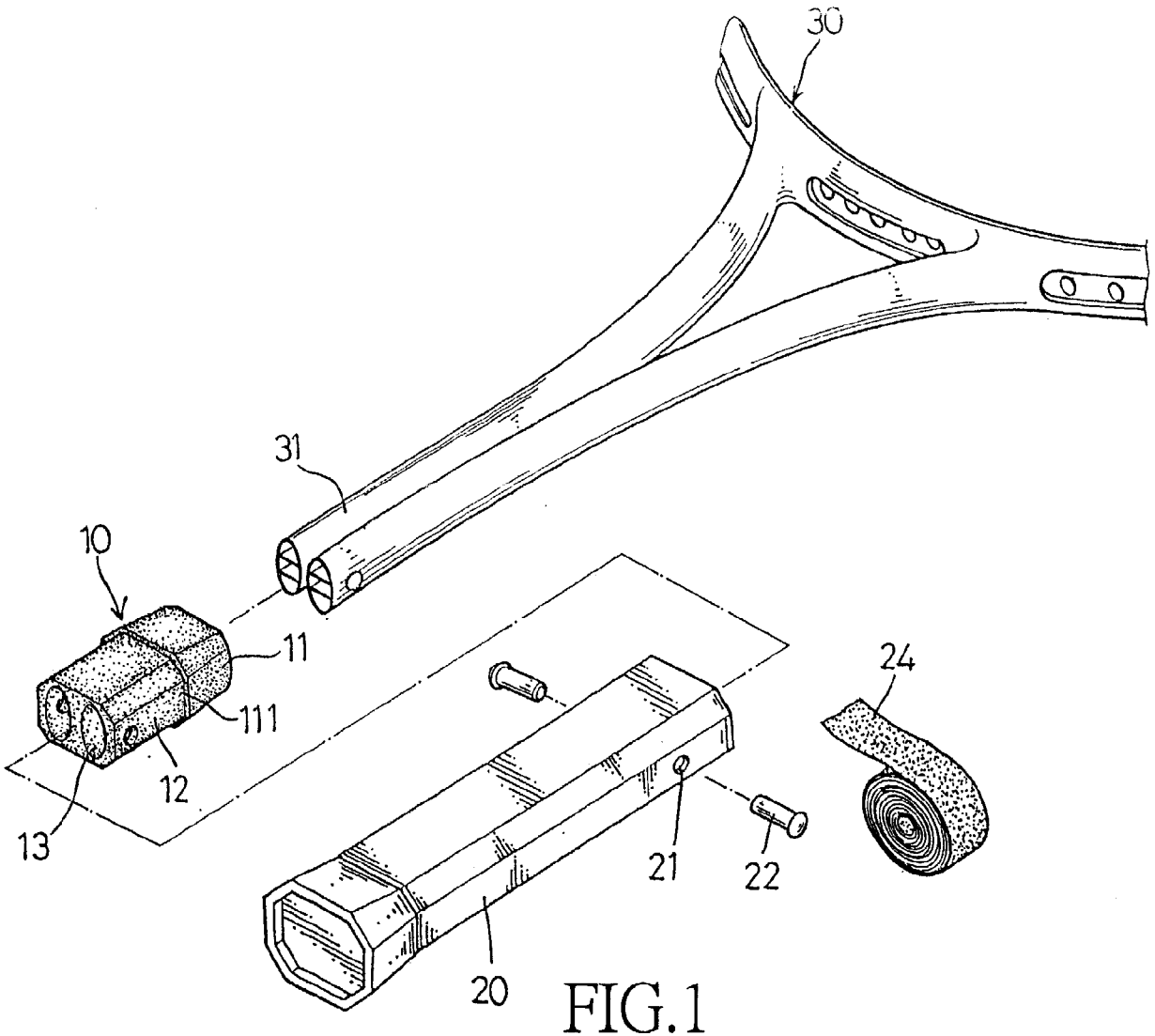
FIG. 1 is an exploded perspective view of a first embodiment of a metal racket in the present invention.
Figure 2:
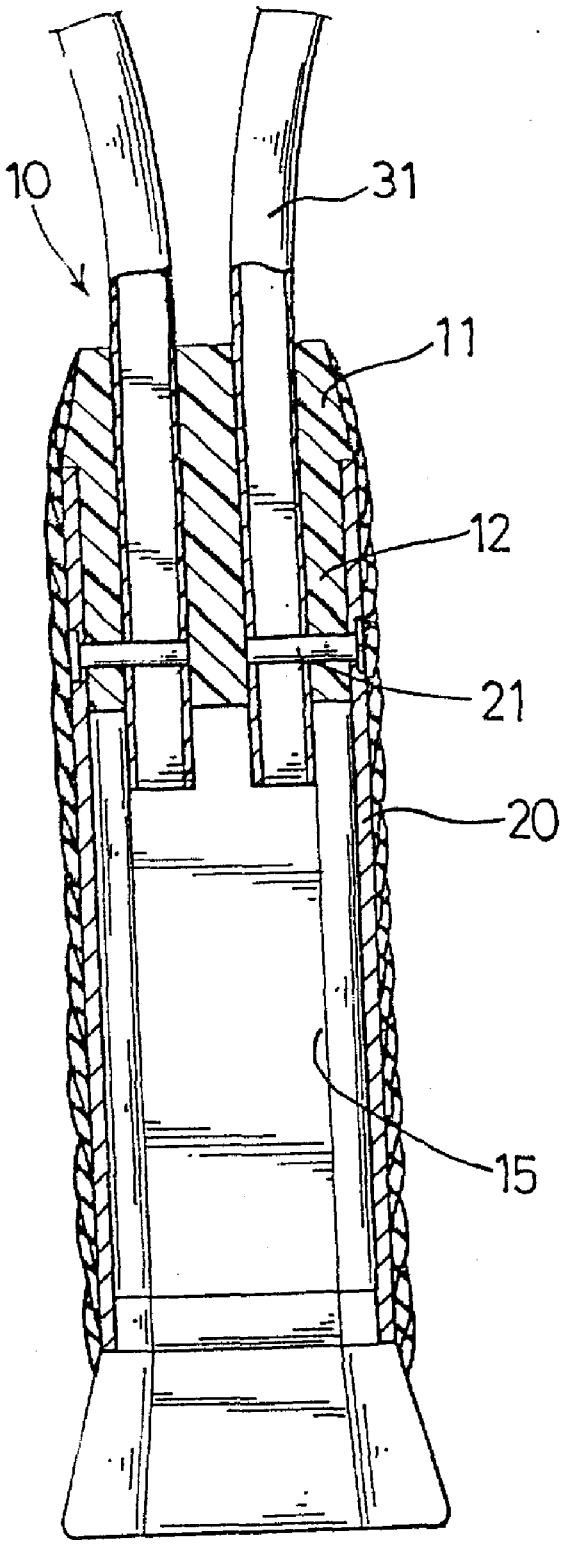
FIG. 2 is a cross-sectional view of the first embodiment of the handle of the metal racket in the present invention.

A first embodiment of a metal racket in the present invention, as shown in FIG. 1 and 2, includes a frame 30, a shock-removing member 10, a handle 20, as main components combined together.

The frame 30 is shaped as common rackets, having a lower shaft 31 consisting of two rods.

The shock-removing member 10 is made of a kind of buffer material, having a rear fitting portion 12, and a front cover portion 11 larger than the rear fitting portion 12. So there is a step lip 111 formed in the connecting line. The fitting portion 12 has two fitting holes 13 for two rods of the shaft 31 to fit therein.

The handle 20 has a cylindrical shape, an upper open end, at least a rivet hole 21 formed in two opposite sides (the left and the right side), and an inner hollow interior longer than the shock-removing member 10.

In assembling, the rear fitting portion 12 of the shock-removing member 10 is inserted in the open inner end portion of the handle 20, with the lip 111 of the shock-removing member 10 fitting and adhered with an upper end of the handle 20. Then the two shaft rods 31 are inserted in the fitting holes 13 of the shock-removing member 10 and fixed tightly therein by rivets 22 fitting through the rivet holes 21 of the handle 20. Thus shock reducing space 15 is formed between the lower end of the shock removing member 10 and the lower end of the handle in the hollow interior of the handle, as the two shaft rods 31 are not in a contact condition with the inner side of the handle 20. Finally a wind band 24 is wound around the outer surface of the handle 20.

Figure 3:
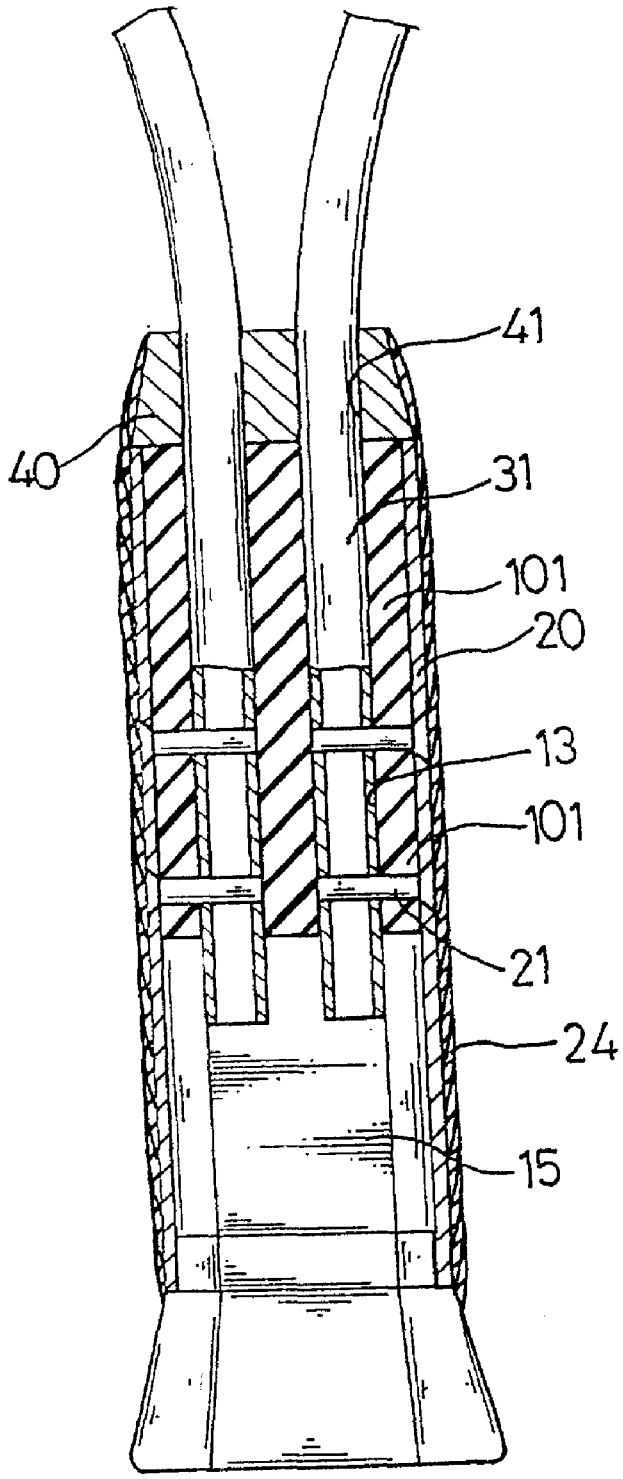
FIG. 3 is a cross-sectional view of a second embodiment of a handle of a metal racket in the present invention.

A second embodiment of the metal racket in the invention is shown in FIG. 3, having the same structure as the first one except that an upper cap 40 is provided, having a solid body with a hole 41 for the two shaft rods 31 to fit through. Then the shaft rods 31 fit through the fitting holes 13 of the shock-removing member 101, and the handle 20 is fixed around the outer surface of the shock-removing member 101. Then the upper cap 40 is fixed on an upper end of the handle 20, and the shock-removing member 20 is kept in the interior of the handle by means of the rivets 22 fixed in the rivet holes 21 and passed through the shock-removing member 101 and the two shaft rods 31. And thus a shock reducing space 15 is still formed in the remaining hollow interior of the handle 20.

Figure 4:
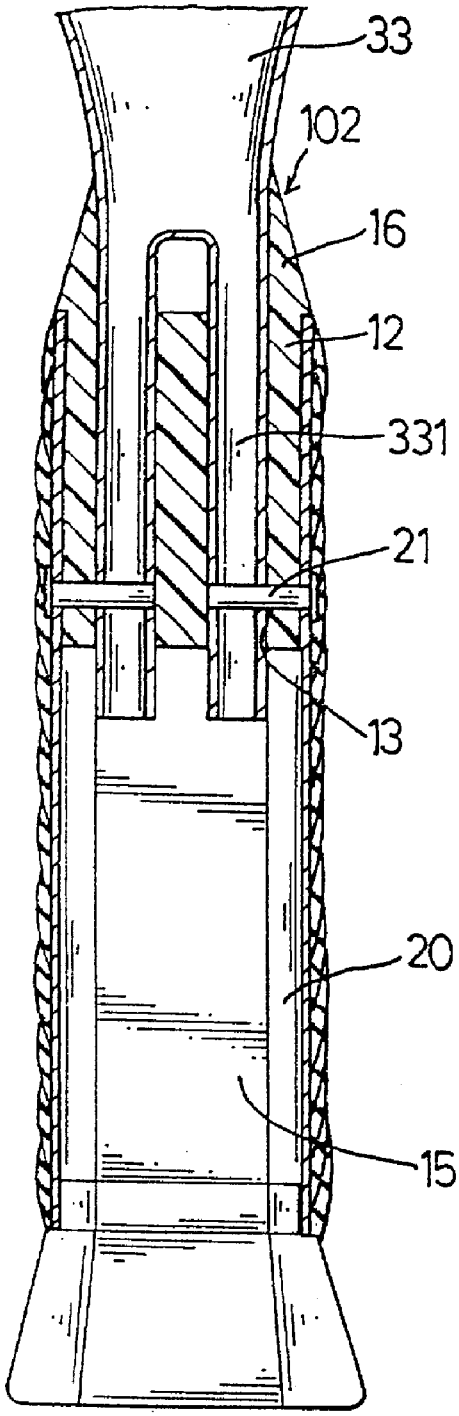
FIG. 4 is a cross-sectional view of a third embodiment of a handle of a metal racket in the present invention; and, FIG. 5 is a cross-sectional view of a fourth embodiment of a handle of a metal racket in the present invention.

A third embodiment of the metal racket in the invention is shown in FIG. 4, having the same structure of the first one except that the shaft rod 33 have the upper ends formed together as one rod, and the lower end portion ramifies into two rods 331. A shock removing member 102 has two fitting holes for the two shaft rods 331 from the upper portion downward, and has a constrict portion 12 to constrict the upper portion of the shaft rod 331, and then rivets 21 are fixed through the handle 20 and the shock removing member 102 and the two rods 331. Thus, a shock reducing space 15 is still formed between The lower end of the handle 20 and the end of the shock removing member 102.

Figure 5:
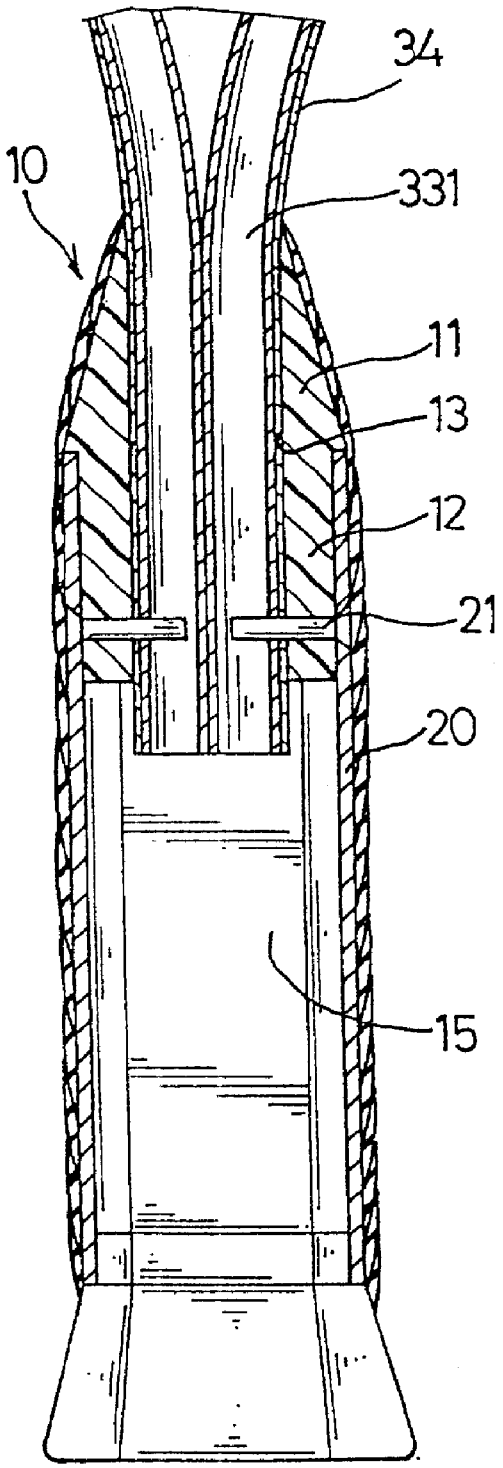

Next, a fourth embodiment of the invention is shown in FIG. 5, having the two shaft rods 34 put together directly side by side to become a connected rod portion 331 to fit in one fitting hole 13 of the shock removing member 10 and inserted in the handle 20 and secured with rivets in the same way as the other embodiment.

This invention has the following advantages, as can be seen from the above description.

1. Only one shock removing member is contained in the handle in addition to a shock reducing space formed between the end of the shock removing member and the lower end of the handle, reducing the weight of the handle largely, letting the center of gravity located in an upper portion of the handle, attaining the objective of lightening the handle effectively.

2. As there is a shock reducing space in the handle, the shock received by the racket may be buffered firstly by the shock removing member, and the rest shock of the end of the handle may vibrate in the shock reducing space. Then the shock reducing space separates the handle from the end of the handle, so the shock force in the end of the handle may not transmitted to other portions of the shock removing member. Then a player may not feel the shock so vividly at the portion of the handle a player holds.

3. The upper portion of the shock removing member can be saved, and the shock removing member 102 can be formed by injecting. The metal racket can be made of aluminum alloy to increase its strength.

While the preferred embodiments of the invention have been described above, it will be recognized and understood that various modifications may he made therein and the appended claims are intended to cover all such modifications which may fall within the spirit and scope of the invention.

What is claimed is:

1. A metal racket comprising:

a frame having a lower end fitted in a shock removing member;

said shock removing member having a center hole for the lower end of said frame to fit therein;

a handle having an upper end open, having at least one rivet hole in two opposite sides, an hollow interior longer than that of said shock removing member, said shock removing member together with said lower end of said frame fitted in an upper inner portion of said handle, said shock removing member fixed immovable with rivets passing through said holes of said handle, a shock reducing space formed between the lower end of said shock removing member and the lower end of said handle.

2. The metal racket as claimed in claim 1, wherein said shock removing member is made of a buffer material, having a rear fitting portion and a front cover portion larger than said rear fitting portion so as to form a lip at the connecting edge of said front and said rear portion.

3. The metal racket as claimed in claim 1, wherein the lower end of said frame is combined with an upper cap and then fits in said shock removing member.

4. The metal racket as claimed in claim 1, wherein said upper portion of said shock removing member has a single hole constrict section for the lower end of said frame to fit therein.

5. The metal racket as claimed in claim 1, wherein said frame is made of aluminum alloy.

6. The metal racket as claimed in claim 1, wherein said shock removing member is formed by an injecting process.

* * * * *